US006532627B2

(12) United States Patent
Audisio

(10) Patent No.: US 6,532,627 B2
(45) Date of Patent: Mar. 18, 2003

(54) HINGE FOR VEHICLE DOORS WITH INTEGRATED DOORSTOP DEVICE

(75) Inventor: Vittorio Audisio, Milan (IT)

(73) Assignee: Gammastamp SpA (IT)

( * ) Notice: Subject to any disclaimer, the term of this patent is extended or adjusted under 35 U.S.C. 154(b) by 0 days.

(21) Appl. No.: 09/819,493

(22) Filed: Mar. 28, 2001

(65) Prior Publication Data

US 2001/0025397 A1 Oct. 4, 2001

(30) Foreign Application Priority Data

Mar. 29, 2000 (IT) ..... TO00A0295

(51) Int. Cl.[7] ..... E05D 11/10
(52) U.S. Cl. ..... 16/334; 16/330; 16/322
(58) Field of Search ..... 16/334, 330, 322, 16/329, 331, 332, 352, 353, 312–314, 300, 321

(56) References Cited

U.S. PATENT DOCUMENTS 1,180,669 A * 4/1916 Oellrich et al. ..... 16/334
1,687,174 A * 10/1928 Mountford et al. ..... 16/334
2,635,281 A * 4/1953 Feldberg ..... 16/274
2,922,669 A * 1/1960 Hansen ..... 16/334
3,028,619 A * 4/1962 Schlage et al. ..... 16/49
4,829,633 A * 5/1989 Kassner ..... 16/250
5,173,993 A * 12/1992 Baker ..... 16/340
6,029,314 A * 2/2000 Kluting et al. ..... 16/322

FOREIGN PATENT DOCUMENTS

EP 0897044 A2 2/1999

* cited by examiner

*Primary Examiner*—Chuck Y. Mah
(74) *Attorney, Agent, or Firm*—TraskBritt

(57) ABSTRACT

A hinge for vehicle doors having a first hinge element (14), a hinge pin (18) rotatably carried by the first hinge element (14) and a second hinge element (16) removably attached to the hinge pin (18). The hinge further includes a retention device (12) including a plurality of rolling members connected in rotation to the pin (18) and cooperating with elastic structure (54) which tends to force the rolling members (38) to engage with a rolling race. The rolling members are balls (38) connected in rotation to the pin (18) via a guiding plate (40) provided with positioning seats (42) for the balls (38).

7 Claims, 4 Drawing Sheets

56
54
49
52
10
12
38
39
44
42
42
38
42
42
32
36
30
A
14
20
58
18
22
28
16
26

HINGE FOR VEHICLE DOORS WITH INTEGRATED DOORSTOP DEVICE

BACKGROUND OF THE INVENTION

1. Field of the Invention

The present invention relates to a hinge for a vehicle doors with an integrated doorstop device that is designed to withhold the door in one or more stable positions, for example in a partially open position and in a fully open position.

2. State of the Art

A hinge having the characteristics described in the preamble to claim 1 from the document EPA-897044. The said document describes a hinge including a first hinge element and a second hinge element articulated together by means of a hinge pin which is carried by the first hinge element in such a way that it can be rotated about a hinge axis and is fixed in a removable way to the second hinge element. This known hinge comprises a doorstop device including a plurality of rollers, which can turn about respective axes set radially with respect to the axis of the hinge. The rollers are carried by a supporting structure which is fixed to the hinge pin. A helical spring in compression pushes the rollers so that they enter into rolling contact against a rolling race which is integral with the first hinge element.

BRIEF SUMMARY OF THE INVENTION

The purpose of the present invention is to provide a hinge for vehicle doors of the type comprising a doorstop device with rolling retention members that is simpler, more compact and more economical than known solutions.

According to the present invention, the above purpose is achieved by a hinge having the characteristics that form the subject of claim 1.

DESCRIPTION OF THE SEVERAL VIEWS OF THE DRAWINGS

The present invention will now be described in detail with reference to the attached drawings, which are provided purely by way of non-limiting example, and in which.

DETAILED DESCRIPTION OF THE INVENTION

Figure 1:
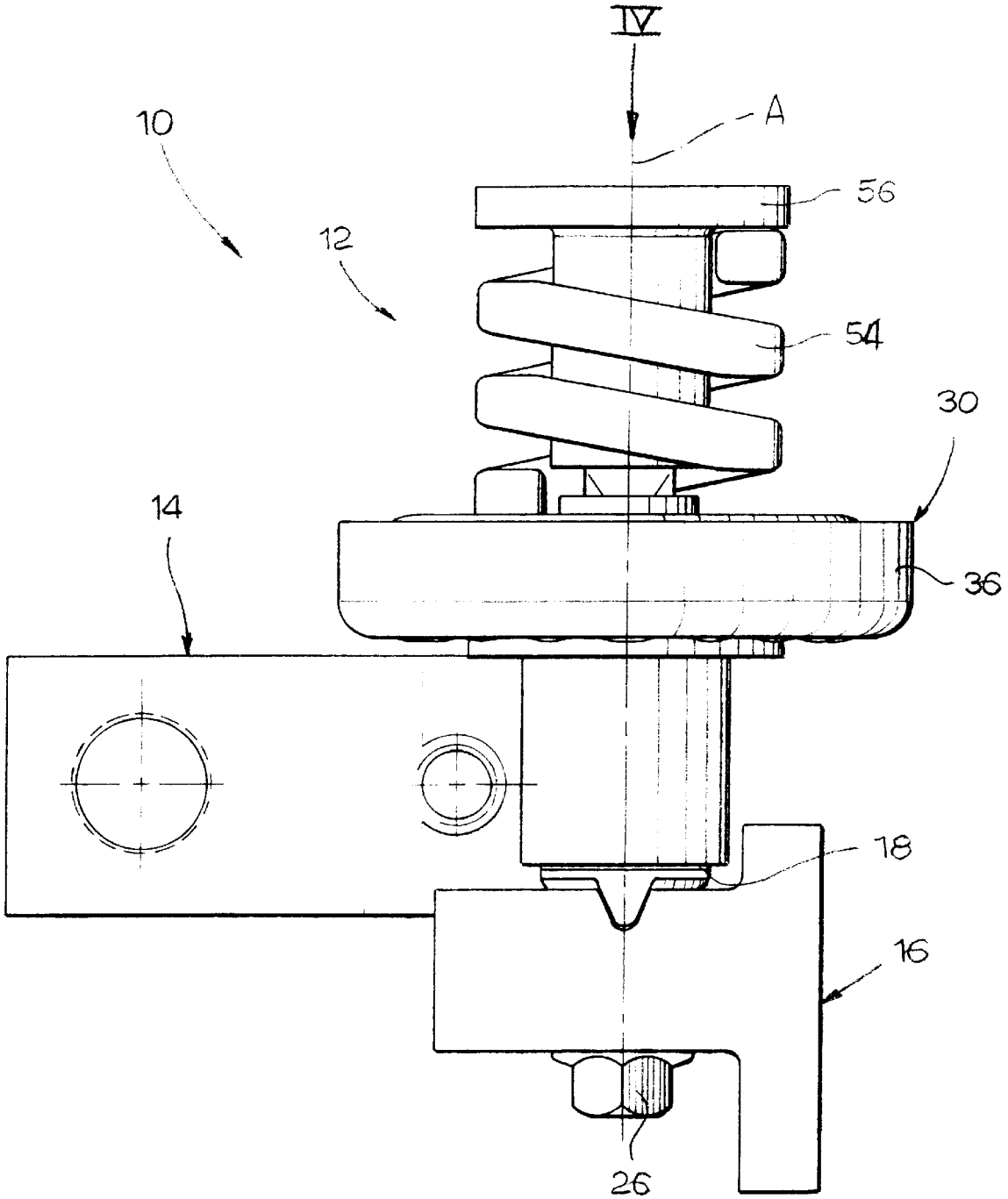
FIG. 1 is a front schematic view of a hinge according to the present invention.
Figure 2:
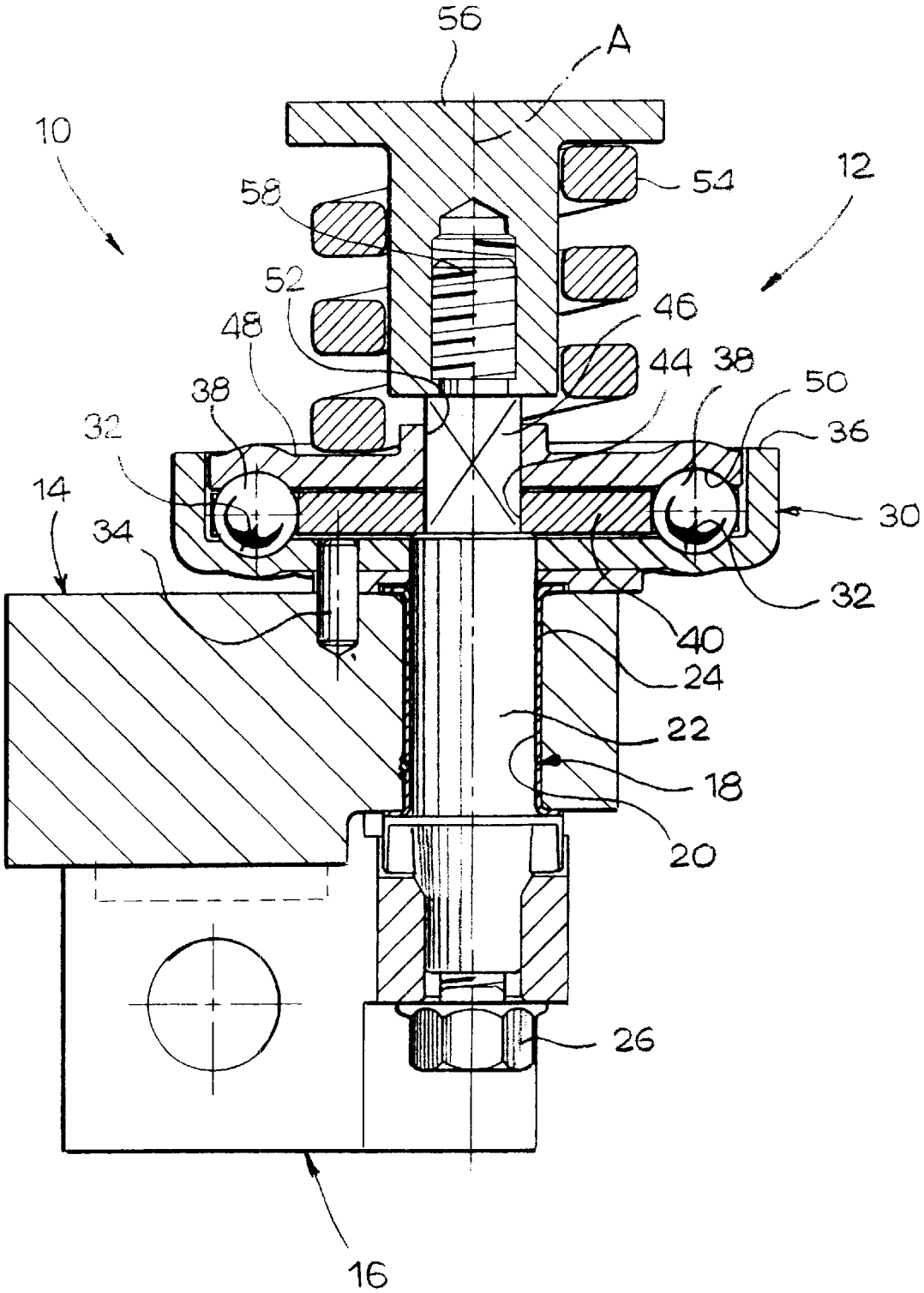
FIG. 2 is an axial section of the hinge of FIG. 1.
Figure 3:
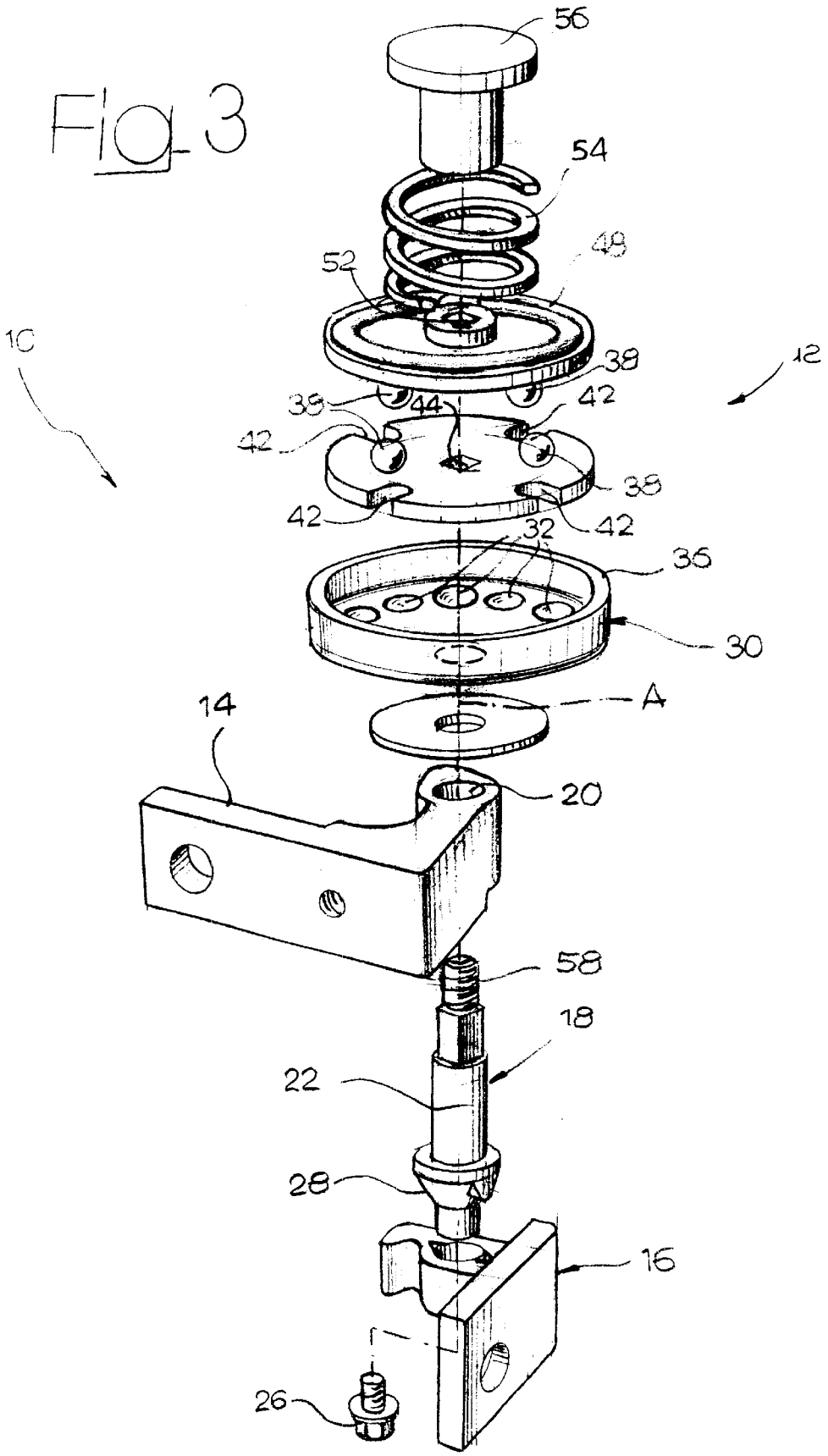
FIG. 3 is an exploded perspective view of the hinge according to the present invention.
Figure 4:
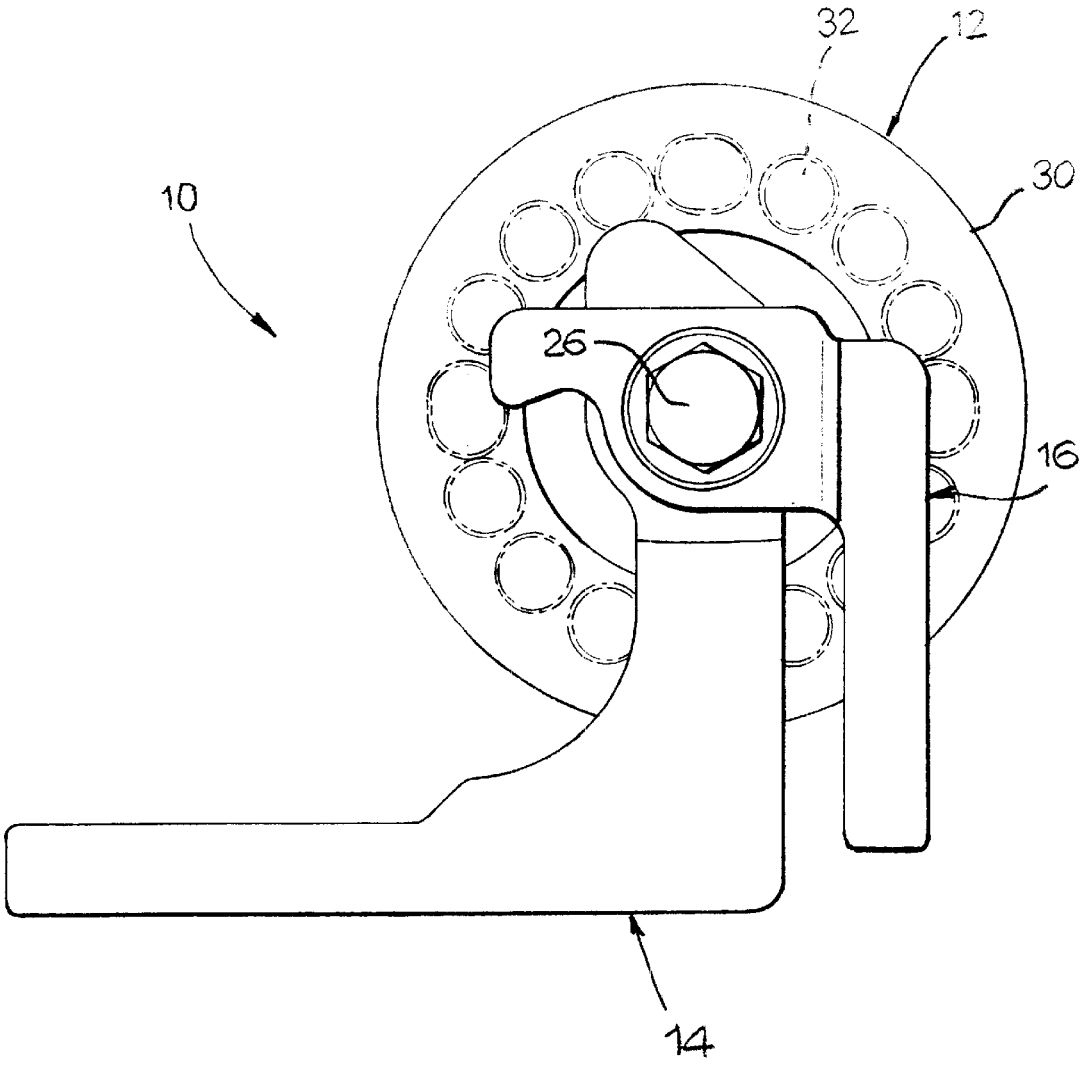
FIG. 4 is a plan view according to the arrow IV of FIG. 1.

With reference to the above figures, the number 10 designates a hinge for vehicle doors comprising a doorstop device 12 integrated in the structure of the hinge. The hinge 10 comprising a first hinge element 14, a second hinge element 16 and a hinge pin 18. The first hinge element 14 has a cylindrical seat 20 in which a cylindrical portion 22 of the hinge pin 18 is mounted so that it can turn, with the interposition of a bushing 24 made of anti-friction material (FIG. 2). The second hinge element 16 is fixed, so that it can be removed, by means of a screw 26 on a fixing portion 28 of the hinge pin 18. The fixing portion 28 has a conical part provided with radial teeth which inserts into a seat having a complementary shape provided on the second hinge element 16.

The doorstop device 12 comprises a cup 30 having an internal surface on which is defined a circular rolling race along which, are formed a plurality of engagement seats 32 formed by impressions having the shape of spherical cups. The cup 30 is integral in rotation with the first hinge element 14, for example by means of a pin 34 (FIG. 2). The cup 30 has a hole through which the hinge pin 18 extends with play. The cup 30 further has a circular side wall 36 which defines the external limit of the rolling race.

Arranged inside the cup 30 is a plurality of balls 38, which, in the example illustrated in the figures, are four in number. A guide plate 40 is provided with seats 42, within which respective balls 38 are withheld. The guide plate 40 is integral in rotation with the hinge pin 18. For example, the guide plate 40 may be provided with a square hole 44, which engages a square portion 46 of the hinge pin 18. The guide plate 40 and the rolling members 38 are thus integral with the hinge pin 18 for movements of rotation about the axis A of the hinge.

The doorstop device 12 further comprises a thrust plate 48 provided with an annular rolling race 50. The thrust plate 48 is integral with the hinge pin 18 for movements of rotation about the axis A of the hinge, but is free to slide axially with respect to the hinge pin 18 along the axis A. For example, the thrust plate 48 is provided with a square hole 52, which engages in a sliding way the square portion 46 of the pin 18.

The retention device 12 further comprises an elastic element 54, consisting, for example, of a helical spring in compression, which exerts on the plate 48 a force directed parallel to the hinge axis A that keeps the balls 38 in rolling contact with the cup 30. The spring 54 is compressed between the plate 48 and a contrast element 56 fixed on the pin 18. For example, the contrast element 56 may be screwed onto a threaded portion 58 of the pin 18.

Operation of the hinge referred to above is described in what follows. A relative movement between the first hinge element 14 and the second hinge element 16 about the hinge axis A produces a relative rotation about the axis A between the guide plate 40 and the cup 30. The balls 38 engage the seats 42 of the guide plate 40 and are thus drawn by the guide plate 40 in relative rotation with respect to the cup 30. The spring in compression 54 pushes the balls 38 against the cup 30. The relative motion between the balls 38 and the cup 30 brings the balls into positions corresponding to respective positioning seats 32. The seats 32 are positioned so that the balls 38 engage the respective seats 32 simultaneously.

The position between the first hinge element 14 and the second hinge element 16 at which the balls 38 engage the seats 32 defines a relative position of stable engagement. In fact, in this position the force of the spring withholds the first hinge element 14 and the second hinge element 16 in the relative position of stable engagement until a rotational torque of a predetermined value sufficient to cause the balls 38 to come out of engagement with the seats 32

The engagement seats 32 are arranged in such a way as to define the stable retention positions with the desired angle between the first hinge element 14 and the second element 16, which corresponds to predefined positions of the door with respect to the vehicle

What is claimed is:

1. A hinge for vehicle doors, comprising:

a hinge pin having a hinge axis;

a first hinge element mounted for rotation on the hinge pin about the hinge axis;

a second hinge element fixed in a removable way to the hinge pin; and a retention device capable of holding the first hinge element and the second hinge element in at least one relative positions the retention device comprising:

a holding element fixed to the first hinge element and having a rolling race with at least one engagement seat;

at least one ball-shaped rolling member;

a thrust-applying element having a surface in contact with the at least one ball-shaped rolling member;

elastic means contacting the thrust-applying element to force the at least one ball-shaped rolling member into engagement with the rolling race; and a guiding plate connected to rotate with the hinge pin and having at least one positioning seat for holding the at least one ball-shaped rolling member, wherein the guiding plate is contained between the holding element and the thrust-applying element.

2. A hinge according to claim 1, wherein the holding element comprises a cup having a rolling race in which a plurality of engagement seats is formed, which have the shape of spherical cups, the cup being provided with a circular side wall defining the outer limit of the rolling race.

3. A hinge according to claim 2, wherein the thrust-applying element comprises a plate-shaped element that is fixed for rotation with the hinge pin and is movable relative to the hinge pin in the direction of the hinge axis.

4. A hinge according to claim 3, wherein the plate-shaped element has a first surface and a second opposite surface, the elastic means directly contacting the first surface and the at least one ball-shaped rolling member directly contacting the second opposite surface.

5. A hinge according to claim 2, wherein the cup is integral in rotation with the first hinge element.

6. A hinge according to claim 2, wherein the guiding plate is contained within the circular side wall of the cup.

7. A hinge according to claim 1, further comprising:

a contrast element secured to an end portion of the hinge pin for compressing the elastic structure, the contrast element being spaced from and formed independent of the guiding plate.

* * * * *